United States Patent [19]

Brant, Jr.

[11] Patent Number: 4,782,313

[45] Date of Patent: Nov. 1, 1988

[54] TRANSMISSION LINE SHORTING SWITCH

[75] Inventor: Donald S. Brant, Jr., South Brunswick Township, Middlesex County, N.J.

[73] Assignee: General Electric Company, East Windsor, N.J.

[21] Appl. No.: 143,109

[22] Filed: Jan. 12, 1988

[51] Int. Cl.[4] ..... H01P 1/10

[52] U.S. Cl. ..... 333/246; 200/159 B; 333/262; 335/5

[58] Field of Search ..... 333/101, 105, 262, 246; 200/153 S, 159 B; 335/4, 5

[56] References Cited

U.S. PATENT DOCUMENTS

| | | | |
|---|---|---|---|
| 2,854,543 | 9/1958 | Wilson | 335/5 |
| 3,036,282 | 5/1962 | Lenctot | 333/262 |
| 4,652,840 | 3/1987 | Kosugi . | |

OTHER PUBLICATIONS

U.S. patent application Ser. No. 052,104, filed Apr. 20, 1987 in the name of Katz.

U.S. patent application Ser. No. 134,121, filed Dec. 17, 1987 in the name of Remer.

*Primary Examiner*—Paul Gensler

*Attorney, Agent, or Firm*—Clement A. Berard, Jr.; William H. Meise

[57] ABSTRACT

A switch arrangement for interrupting signal flow on a microstrip transmission line includes an electromagnetically actuated conductive plunger extending through a hole in the dielectric plate on which the microstrip is formed. The strip conductor end adjacent the hole, and a spring conductive bridging element extends across the hole, fixed to one strip conductor and free to make contact with the other. The plunger is supported by a conductive diaphragm spring connected to the ground plane of the microstrip, thereby eliminating sliding contacts. When actuated, the plunger simultaneously lifts the bridging element free from the one strip conductor and short-circuits the other.

6 Claims, 8 Drawing Sheets

TRANSMISSION LINE SHORTING SWITCH

This invention relates to switches adapted for preventing the transmission of signals along unbalanced transmission lines.

In many communication systems electrical signals are transmitted from one location to another by means of electrical conductors. Transmission of an electrical signal by means of electrical conductors requires two conductors, as in the ordinary lamp cord. When significant amounts of data are to be transmitted from one location to another, it is common to modulate the information signals onto a "carrier" signal at a higher frequency than the information signal. The carrier signal is then transmitted to a receiving location, possibly in conjunction with other carrier signals modulated with different information, and at the receiving location a particular carrier may be selected by a tuned circuit and the information carried thereby may be demodulated for use at the receiving location.

As the amount of data to be transmitted has increased, the frequencies of the carriers which have been used have increased into the hundreds and thousands of megahertz. At such frequencies, the electrical wavelength of the carrier signal becomes relatively small by comparison with the physical structures by which the signal is carried. For example, at a frequency of ten thousand megahertz, the wavelength is about one inch. Structural discontinuities having physical dimensions of as little as one tenth of a wavelength can affect the signal. Consequently, the conductor pairs on which signals are carried must be very smooth and without discontinuities. A pair of conductors for carrying signals which is substantially free of discontinuities is termed a transmission line.

Several types of transmission lines have been found to be advantageous for microwave and millimeter-wave use. Coaxial transmission lines include a cylindrical outer conductor and a concentric inner conductor separated by a dielectric. Coaxial cable is well adapted for carrying signals from one location to another, but is less advantageous when circuit elements must be coupled to the conductors. A particularly advantageous type of transmission line is the "microstrip" transmission line, which includes a flat slab of dielectric material having broad upper and lower surfaces. The lower broad surface is completely covered by one of the conductors, termed the "ground plane", and the other conductor is formed as a strip on the opposite surface of the dielectric plate. The strip conductor is very advantageous because it can be formed by photographic and etching methods, and it is very convenient for the coupling of circuit elements, such as transistors, capacitors and the like.

Communication circuits often require switching functions. For some purposes, switching diodes such as PIN diodes may be coupled between the strip conductor of a microstrip line and its ground plane, and may be biased into a conducting condition in order to short-circuit the strip conductor to the ground plane for creating a substantial discontinuity in the transmission line which causes electrical signal propagating in the region associated with the strip conductor and the ground plane to be reflected back toward its source. Solid-state switches may be disadvantageous for some applications because they tend to be nonlinear, and because they require biasing circuits that are electrically coupled to the strip conductor.

Mechanical switches are known which short-circuit a strip conductor of a microstrip line to the adJacent ground plane. FIGS. 1*a* and 1*b* illustrate in sectional isometric and elevation views, respectively, a shorting switch as described in U.S. patent application Ser. No. 052,104 filed Apr. 20, 1987 in the name of Katz. In FIG. 1, a flat dielectric plate 10 has its bottom surface coated with a conductive ground plane 12. Upper surface 13 of dielectric plate 10 supports an elongated strip conductor designated generally as 14, which includes portions 14*a* and 14*b* separated by a through hole 18 which extends from the upper surface of a strip conductor 14 through dielectric plate 10 and ground plate 12. Strip conductor 14 coacts with dielectric plate 10 and ground plate 12 to form a microstrip transmission line. A metallic cap 16 is connected to the upper surface of transmission line 14 in conductive contact with portions 14*a* and 17*b*, and bridging hole 18 with conductive material. Cap 16 is dimensioned to resist the forces occasioned by switch actuation. A composite switch plunger 20 is slideably mounted within hole 18 and makes conductive contact along its sides with grounding springs 22 and 24, which in turn make conductive contact with the ground plane 12. In addition to providing contact with ground, spring contacts 22 and 24 tend to retain plunger 20 in position. The lowermost portion of composite plunger 20, as illustrated in FIG. 1, is a magnetic portion 20*a*. Portion 20*a* may be made from soft iron, ferrite or other magnetic material, while the conductive upper portion 20*b* is made from a nonmagnetic conductive material such as copper. An electromagnet in the form of a coil 26 consisting of conductive windings surrounds plunger 20 and has leads 39 adapted to be coupled to a switch actuation control unit (not illustrated). FIG. 1*b* is an elevation view of the near face of the arrangement of FIG. 1*a*. More clearly visible in FIG. 1*b* is a dielectric bushing 28 which may be part of a bobbin or form on which windings 26 are wound, and which tends to maintain alignment of plunger 20. Also visible in FIG. 1*b* is a layer of adhesive material 30 which holds magnetic windings 26 and bushing 28 affixed to the lower surface of ground plane 12.

In operation, current applied to windings 26 forms a magnetic field near coil 26 which tends to attract magnetic portion 20*a* of plunger 20 upward, thereby driving the entire plunger upward and causing the conductive tip of plunger 20 to contact cap 16. Since cap 16 is in conductive contact with strip conductor 14, and plunger 20 makes conductive contact with ground plane 12 by way of spring clips 22 and 24, a short, relatively low inductance conductive path is thereby formed between strip conductor 14 and ground for grounding the microstrip transmission line at the location of hole 18. This, in turn, creates a substantial discontinuity which attenuates or prevents signal from propagating from one end of the transmission line to the other. An inexpensive and effective switch is desired which short-circuits a microstrip transmission line.

SUMMARY OF THE INVENTION

A shorting switch for a transmission line includes a dielectric plate with upper and lower major surfaces. The plate defines nn aperture extending between the upper and lower surfaces of the dielectric plate. First and second unbalanced transmission lines terminate adjacent the periphery of the aperture in the dielectric plate. Each of the transmission lines includes an elongated strip conductor lying on the upper major surface of the dielectric plate. A bridging element of conductive material is mechanically and electrically connected to a strip conductor of a first transmission line and extends across at least a portion of the aperture to rest in contact with the strip conductor of the second transmission line. In its rest state, the bridging element forms a continuous circuit which provides coupling between the first and second transmission lines. The bridge is opened, and the first transmission line is grounded by a grounding arrangement including a conductive plunger mounted in the aperture and actuable between retracted and actuated positions. In the retracted position, the plunger does not make contact with the bridging element. In the actuated position, the plunger presses against and lifts the bridging element so as to disconnect the bridging element from the strip conductor of the second transmission line. As a result, not only is the first transmission line short-circuited to ground by a low impedance path by contact of the plunger with the bridging element, but in addition the bridging element is disconnected from the second transmission line. As a result, the second transmission line is not terminated in a single-turn winding. Thus, there is no transformer coupling in the actuated position. In a particular embodiment of the invention, a conductive diaphragm spring is mechanically and electrically connected to the conductive plunger and to the ground conductor thereby avoiding the possibility of changes in electrical resistance. The diaphragm spring flexes during actuation. In another embodiment of the invention, the diaphragm spring is in the form of a bowed annulus. In another embodiment of the invention, the diaphragm spring includes non-radial struts or springlets.

DESCRIPTION OF THE DRAWING

FIG. 1*b* is an elevation view of a major face of the arrangement of FIG. 1*a*;

DESCRIPTION OF THE INVENTION

Figure 1A:
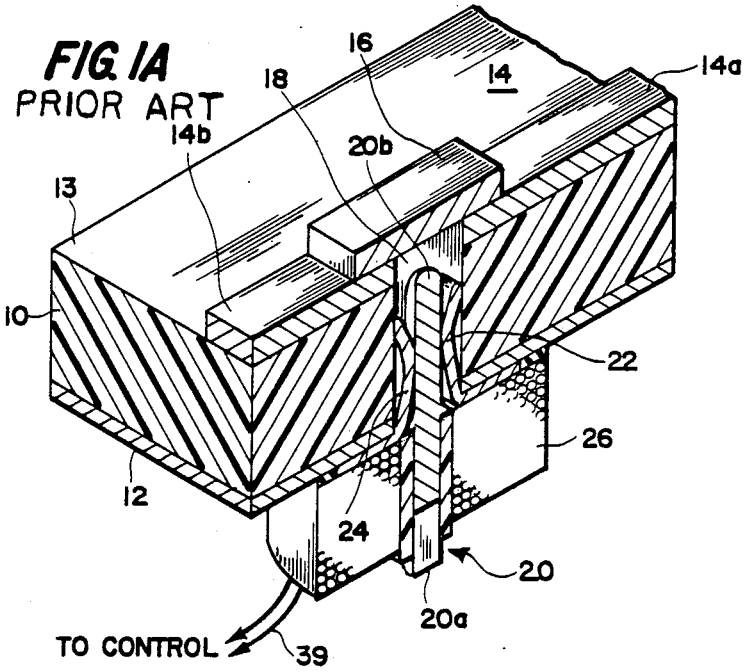
FIG. 1A PRIOR ART
FIGS. 1*a* and 1*b*, referred together jointly as FIG. 1, illustrate in FIG. 1*a* a view of a section of a grounding switch according to the aforementioned Katz patent application.
Figure 1B:
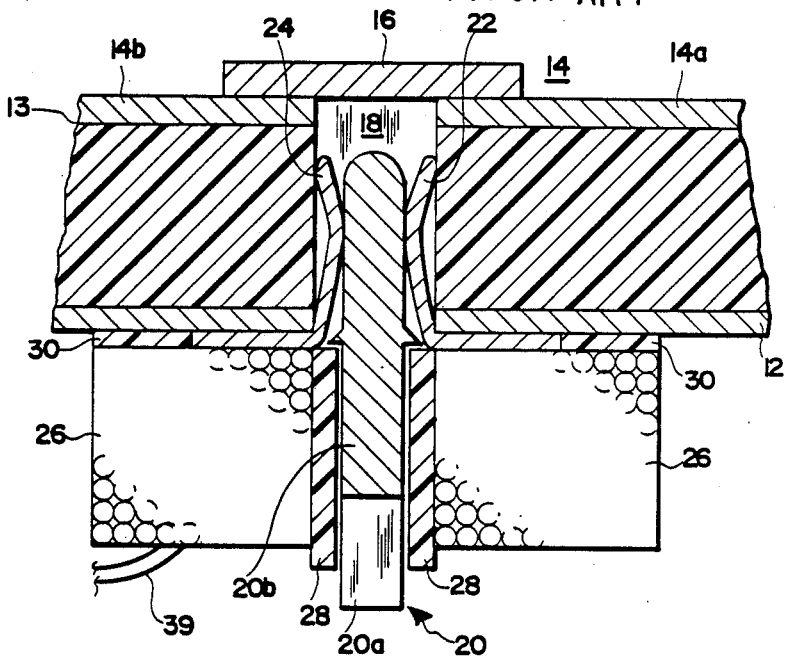
FIG. 1B PRIOR ART
Figure 2A:
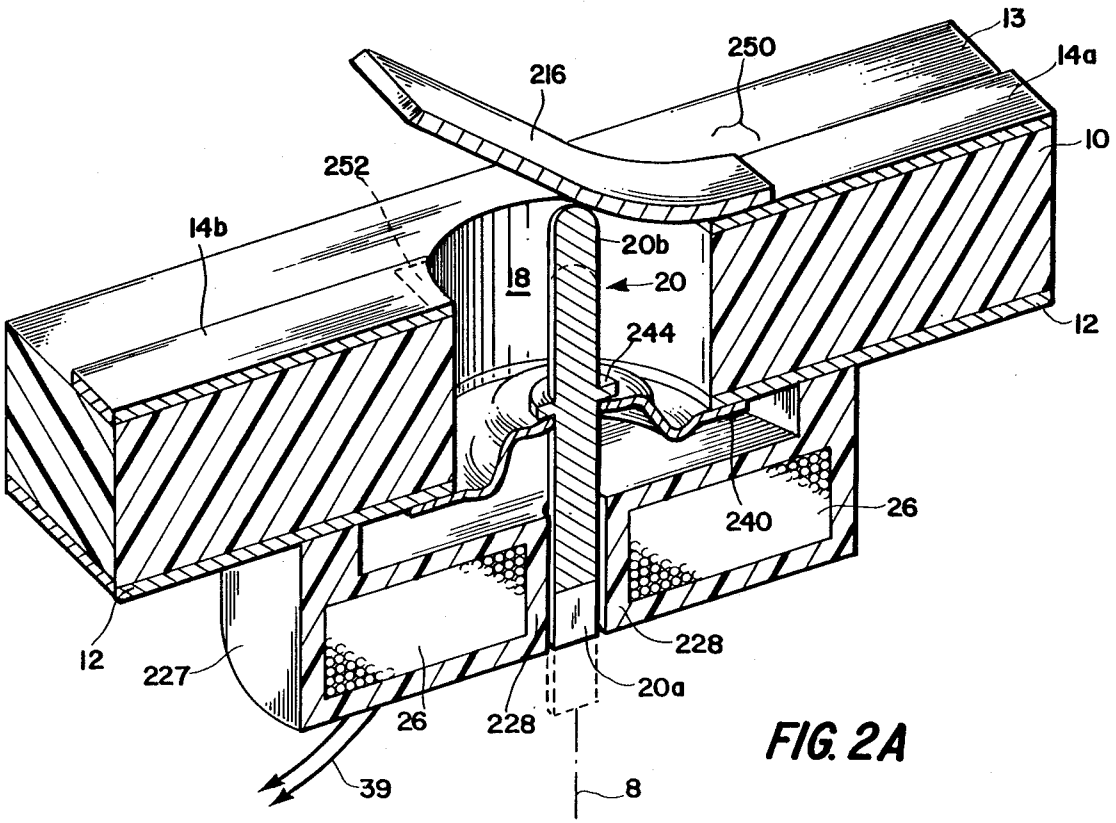
FIGS. 2*a* and 2*b*, referred to jointly as FIG. 2, are a perspective or isometric view, and a sectional elevation view, respectively, of a switch according to the invention using a wavy or bowed diaphragm for support and electrical contact.
Figure 2B:
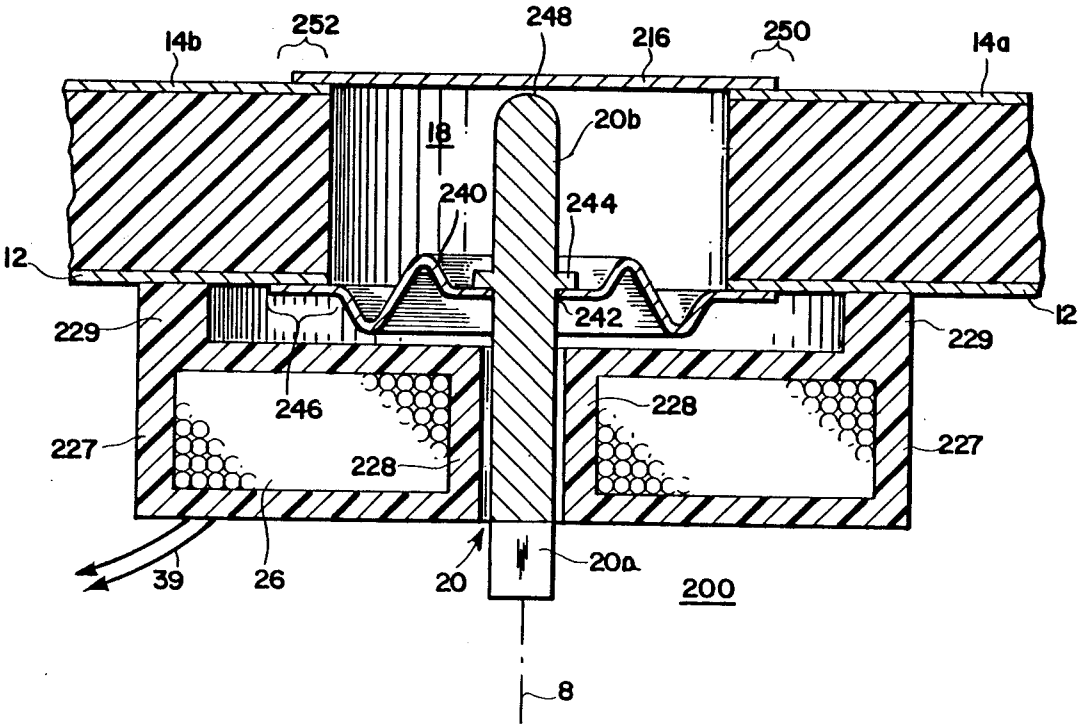

FIG. 2 illustrates a switch arrangement according to the invention. Elements of FIG. 2 corresponding or substantially corresponding to those of FIG. 1 are designated by corresponding reference numerals, or by corresponding reference numerals in the 200 series. In FIG. 2*a*, plunger 20 is supported and held in a rest position by a solid conductive diaphragm spring 240. FIG. 2*b* is an elevation view taken through axis 8 of plunger 20. Referring to FIGS. 2*a* and 2*b*, diaphragm spring 240 is annular and defines a central aperture 242 through which the main body of plunger 20 fits, but which is smaller than a shoulder 244. Plunger 20 is firmly affixed to, and makes electrical contact with diaphragm spring 240, as by metallurgical bonding. Diaphragm spring 240 also includes an external annular support region illustrated as 246, which is mechanically and electrically connected to ground conductor 12 near the periphery of aperture 18. As illustrated, diaphragm spring 240 is formed with annular bows or waves which extend in the direction of central axis 8. This type of diaphragm spring allows plunger 20 to move axially. In its rest position, diaphragm spring 240 holds plunger 20 with the nose 248 of conductive portion 20*b* spaced away from a flexible or springy bridging element 216. Bridging element 216 is mechanically and electrically bonded in a region 250 to strip conductor 14*a*. The corresponding portion 252 where springy bridging element 216 contacts strip conductor 14*b* is not bonded, but is free to move.

As mentioned, in the rest position of plunger 20 illustrated in FIG. 2*b*, nose 248 of conductive portion 20*b* of plunger 20 is not in contact with springy bridging element 216. Consequently, springy bridging element 216 remains in its rest position, mechanically biased or stressed so as to maintain electrical contact with strip conductor 14*b* in region 252, thereby providing a continuous circuit path between the transmission lines represented by strip conductors 14*a* and 14*b*.

As illustrated in FIG. 2*b*, coil 26 is enclosed in a nonconductive coil bobbin 227 having a projecting portion 229 which bears against the lower surface of ground conductor 12 and which is adhesively bonded thereto. Since diaphragm washer 240 provides centering support for plunger 20, walls 228 of bobbin 227, defining an aperture through which plunger 20 extends, need not be as close a fit as in the arrangement of FIG. 1. The material of bobbin 227 may be made from a slippery plastic such as polyethylene so that the bushing defined by walls 228 do not impede plunger actuation.

In the actuated position of plunger 20*b* illustrated in FIG. 2*a*, current applied by way of conductors 39 to coil 26 tends to draw magnetic portion 20*a* of plunger 20 closer to the coil, thereby driving nose 248 of plunger 20 against springy bridging element 216, lifting the left end of element 216 away from strip conductor 14*b*. With nose 248 of plunger 20 in contact with bridging element 216, the transmission line represented by strip conductor 14*a* is short circuited to ground conductor 12 by way of conductive portion 20*b* of plunger 20, and conductive diaphragm spring 240. Since conductive portion 20*b* of plunger 20 is connected directly to ground conductor 12 by way of the continuous path of diaphragm spring 240, there are no sliding contacts between the plunger and ground with the potential for becoming dirty and erratic. Furthermore, since contact is made between the plunger and ground by a radial conductor, the resistance and impedance to ground may be lower than in the arrangement of FIG. 1. Furthermore, the arrangement of FIG. 2 is advantageous because nose 248 of plunger 20*b* tends to wipe across the bottom surface of springy bridge element 216 as it lifts during the actuating process, thereby tending to clean the contact region more than a plunger which simply contacts a point without wiping. This tends to reduce the contact resistance at the nose and to provide an improved short-circuit.

As a further advantage of the arrangement of FIG. 2, the lifting of the free end of springy bridge element 216 away from contact with strip conductor 14*b* during actuation results in open-circuiting of the corresponding transmission line, so that the transmission line represented by strip conductor 14*b* is not terminated in a single-turn transformer. Thus, even though a magnetic field is set up about the single-turn transformer winding including plunger 20 as a result of the flow of short-circuit current therethrough from strip conductor 14*a* (for signal flow to the left from portion 14*a* to portion 14*b*), there is no corresponding magnetic coupling element connected to strip conductor 14*b* to couple the magnetic field thereto.

Figure 3:
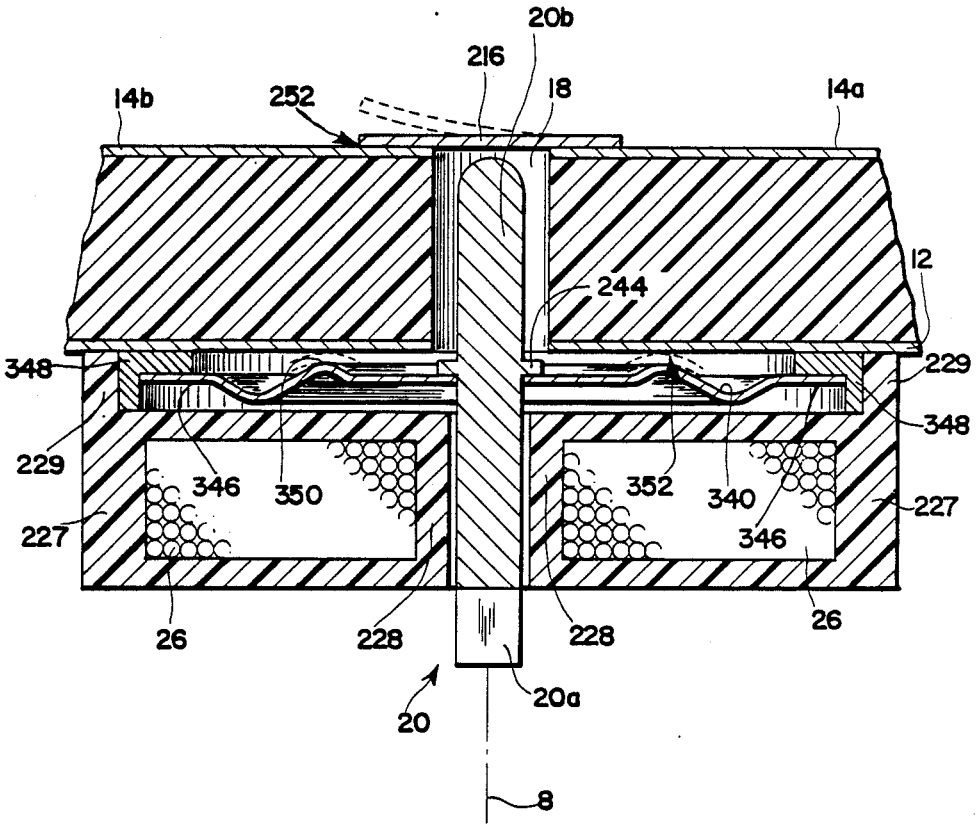
FIG. 3 is an elevation view of a section of another switch according to the invention using a wavy or bowed diaphragm with a larger diameter of that of the arrangement of FIG. 2.

FIG. 3 is an elevation view of a section of another embodiment of a switch in accordance with the invention. Elements of FIG. 3 corresponding to those of FIG. 2 are designated by the same reference numerals, or by the same reference numerals in the 300 series. The arrangement of FIG. 3 differs from that of FIG. 2 in that diaphragm spring 340 which supports plunger 20 is larger in diameter than aperture 18. As illustrated in FIG. 3, diaphragm spring 340 has a sinusoidal shape similar to that of spring 240 of FIG. 2. Diaphragm spring 340 is supported in an annular region 346 by a metallurgical connection to a flanged conductive washer 348, which is metallurgically bonded to ground conductor 12 at a location centered on axis 8 of hole 18. While it might appear that the path length to ground in the arrangement of FIG. 3 is greater than that of the arrangement of FIGS. 1 and 2 and might therefore provide greater inductance, diaphragm spring 340 is dimensioned so that in the actuated position, annular peak porton 350 of the annular bow makes contact with ground plane 12 near a location 352. Even if the connection between diaphragm spring 340 and ground conductor 12 at location 352 should eventually become dirty, the metallurgical connection through flanged conductive washer 348 prevents a catastrophic increase in contact resistance and/or inductance.

Figure 4A:
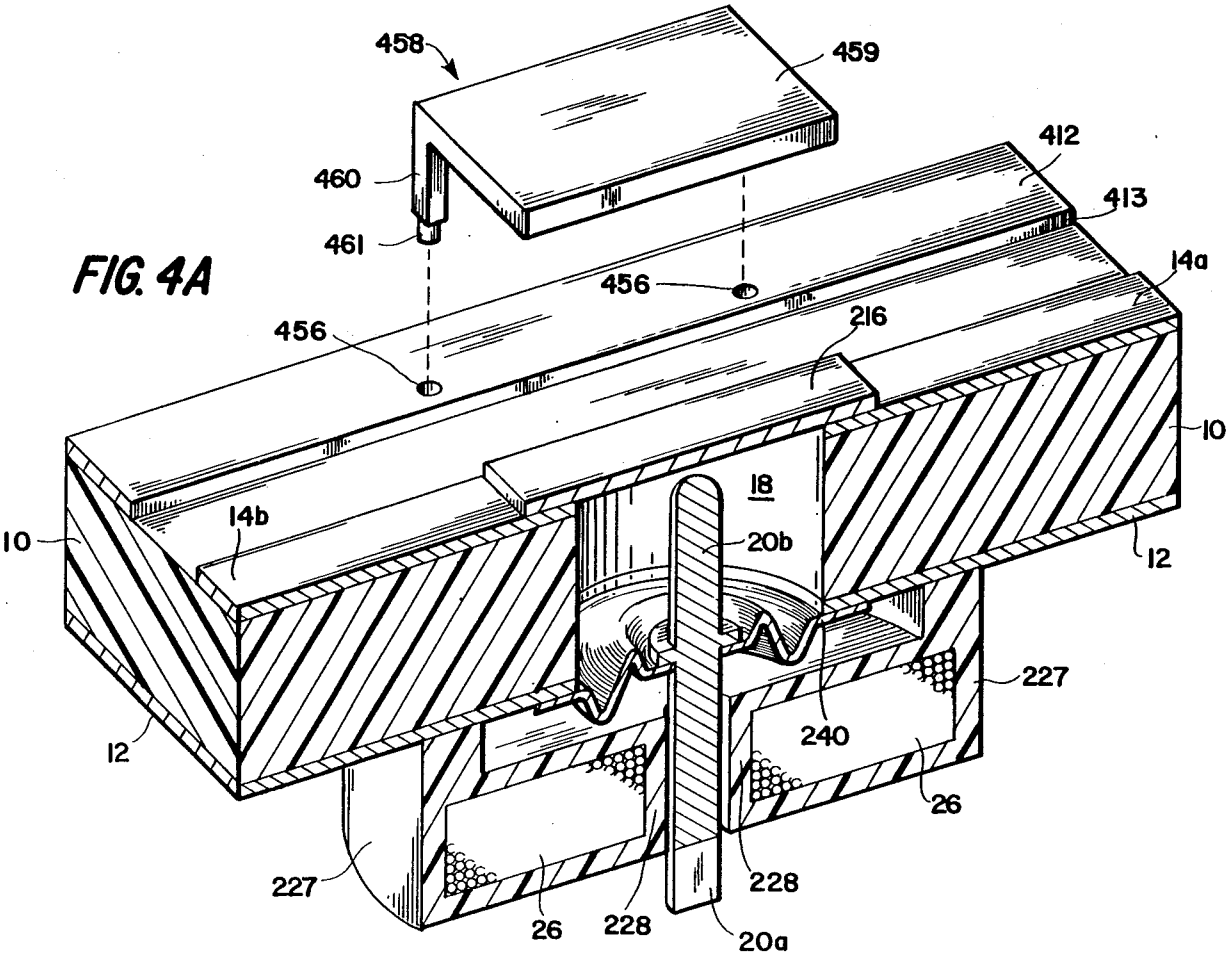
FIGS. 4*a*, 4*b*, 4*c* and 4*d*, referred to jointly as FIG. 4, illustrate in FIG. 4*a* a perspective or isometric exploded view of a section of a switch according to the invention including a further ground conductor, in FIG. 4*b* a cross section of the switch of FIG. 4*a* in its assembled, actuated condition, in FIG. 4*c* an alternative form of further ground conductor which may be used in the arrangement of FIG. 4*a*, and in FIG. 4*d* a further alternative form of further ground conductor with additional grounding legs.
Figure 4B:
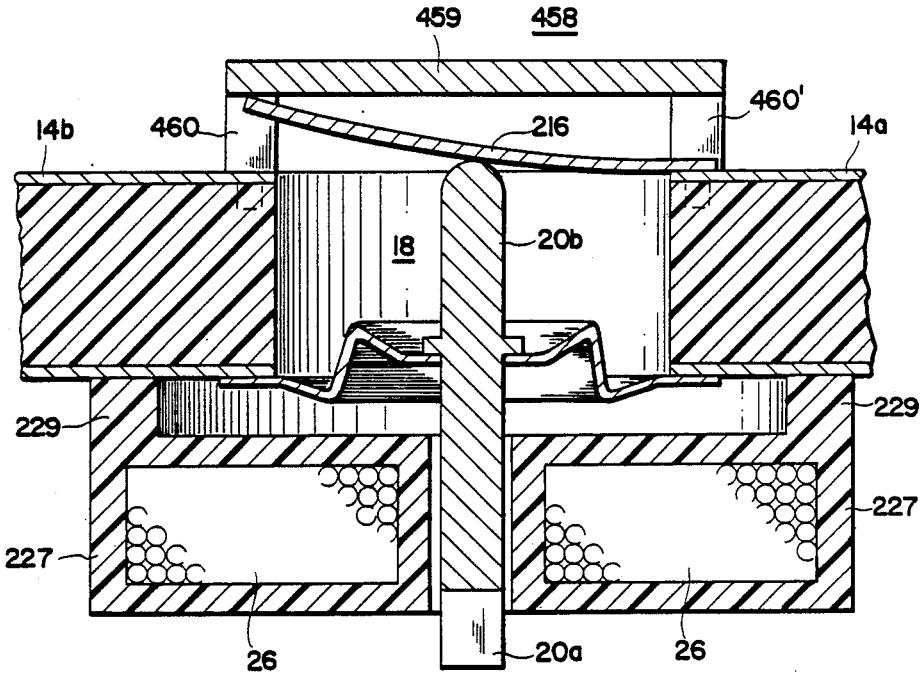

As illustrated in FIG. 3, flanged washer 348 provides centering support for projecting portion 229 of nonconductive bobbin or enclosure 227 of coil 26. FIGS. 4*a* and 4*b* together illustrate an arrangement similar to that of FIG. 2 in which a further ground plane conductor 412 is situated on the upper side of dielectric plate 10, with an edge 413 extending parallel to the edges of strip conductors 14*a* and 14*b*. A pair of mounting holes 456 extend through ground conductor 412. A further conductive body 458 includes a pair of leg elements 460 (only one of which is visible in FIG. 4*a*) somewhat larger than the diameter of holes 56, terminating in foot portions 461 extending below leg portions 460 and dimensioned to fit within holes 456. When assembled, foot portions 461 are metallurgically bonded, as by soldering to ground conductor 412. An extension 459 extends from legs 460 and is dimensioned to overlie springy bridging element 216, as illustrated in more detail in the assembled elevation view of FIG. 4*b*. As illustrated more particularly in FIG. 4*b*, the arrangement of FIG. 4 has the advantage that, when plunger 20*b* is in its actuated position, pressing against and lifting the free left end of springy bridging element 216 from strip conductor 14*b*, the free end of springy bridging element 216 comes into contact with the underside of extension 459, thereby providing an additional coupling path to ground, and thereby further reducing the inductance and resistance of the shorting path.

Figure 4C:
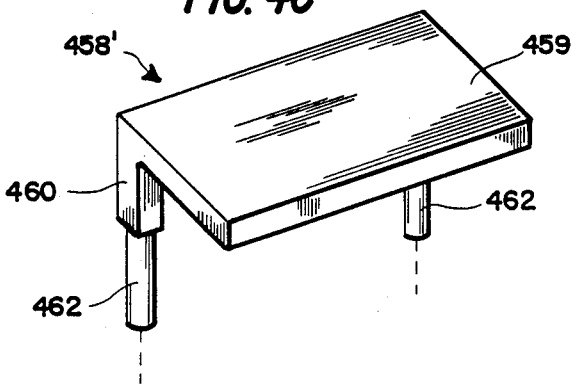

FIG. 4*c* illustrates an alternative arrangement of the additional conductive element 458. In FIG. 4*c*, element 458' is similar to element 458 of FIG. 4*a*, but includes longer foot portions 462. Additional conductor 458' of FIG. 4*c* is particularly advantageous for those occasions in which upper ground conductor 412 of FIG. 4*a* is absent, but a second grounding path is desired. Instead of being shallow holes through upper ground conductor 412, holes 456 extend from the upper surface of the dielectric plate 10 and through lower ground conductor 12. The feet 462 of conductive element 458' of FIG. 4*c* are soldered at the bottom where they extend throu4h ground plane 12 and, if ground plane 412 is present as in FIG. 4*a*, they are soldered at the top where they pass through ground plane 412.

Figure 4D:
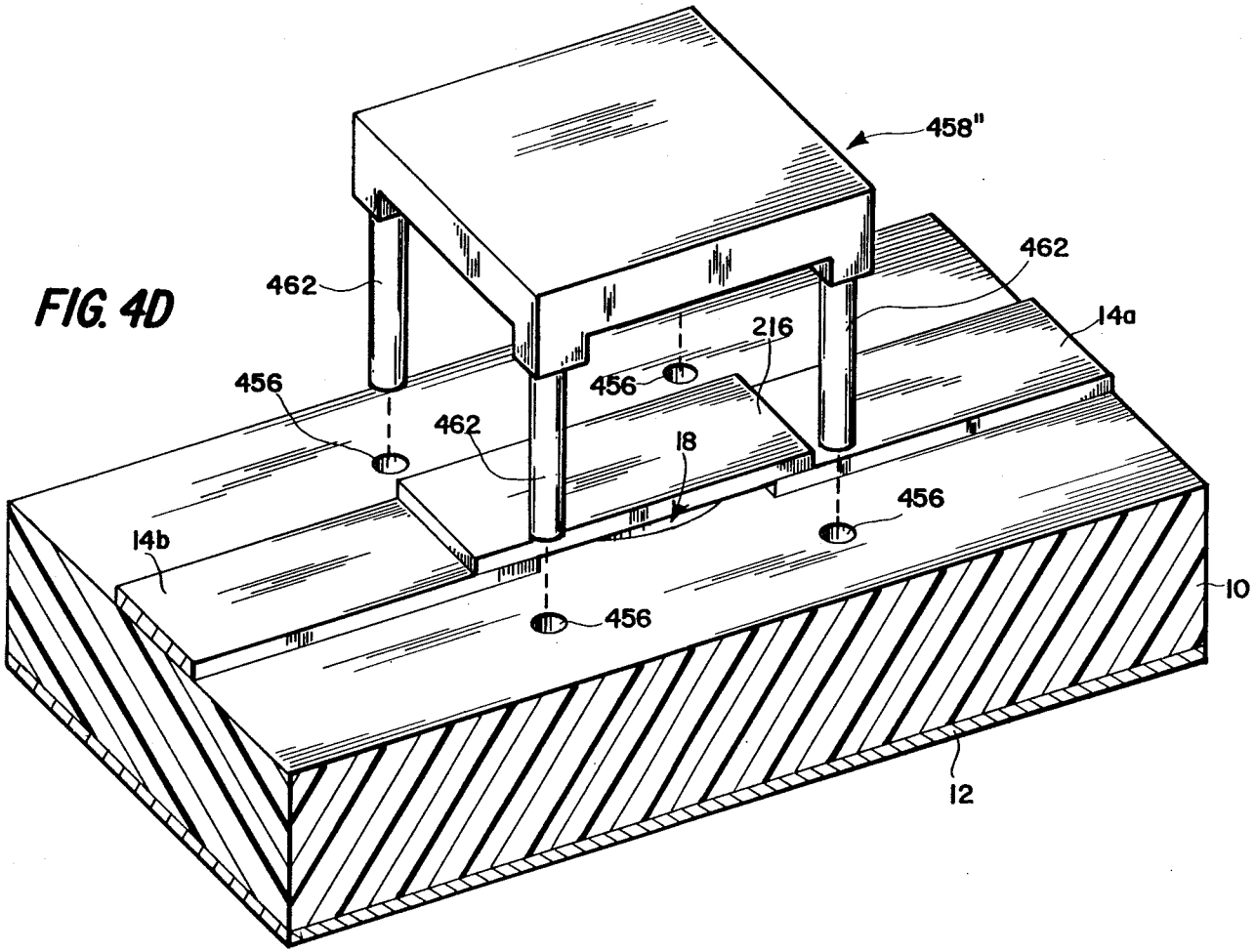

The arrangement of FIG. 4*d* illustrates a further conductor 458'' similar to 458 and 458' of FIGS. 4*a* and 4*c*, respectively, but with four feet 462 adapted for extending through holes 456 to make contact with ground conductor 12.

Figures 5A, 5B, 6:
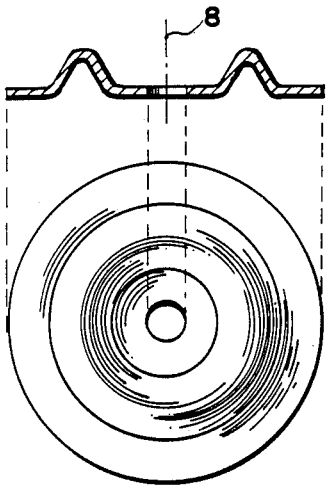
FIGS. 5*a* and 5*b* illustrate another configuration of a bowed solid diaphragm spring.
FIG. 6 illustrates the configuration of a flat diaphragm spring.

FIG. 5*a* illustrates a cross-sectional view, and FIG. 5*b* an elevation view, of a conductive diaphragm spring which is bowed or wavy in a direction which is unidirectionally away from the plane of the spring, rather than being bidirectional as with springs 240 and 340.

As described in copending patent application Ser. No. 134,121 filed Dec. 17, 1987 in the name of Remer, a flat diaphragm spring may be used to provide axial motion. The Remer spring arrangement provides a high self-resonant frequency, together with smooth axial motion. The diaphragm spring as described in the Remer application is illustrated as 60 of FIG. 6. In FIG. 6, an inner support region 43 is not available for flexure, and is intended to be metallurgically affixed (or clamped by means of screws extending through holes 64) to the outer periphery of plunger 20, which extends axially through central aperture 61.

The flexing or resilient portion 69 of diaphragm spring 60 consists of a plurality of nonradial support arms or struts connecting inner support portion 63 to outer support portion 67. Each of the support arms is an elongated element with substantially straight, substantilly parallel sides which are angled with respect to radial lines extending from the center at axis 8. Typical support arms are illustrated as 612, 614, and 616 . . . , which are defined by triangle-like cut-away portions 622, 624, 626 . . . Each cut-away portion 622, 624, 626 . . . preferably has two substantially straight sides joining at a vertex adjacent dashed line 662, and includes a curved third side which follows dashed line 668. The thickness of each support arm 612, 614, 616 . . . in a direction perpendicular to the plane of FIG. 6 is the same as the thickness of the remainder of the material of the diaphragm spring. As illustrated, the inner and outer support portions of the spring, and the central resilient portion, are all formed from a monolithic sheet of material.

The angle made by the sides of each support arm with radials emanating from central axis 8 is such that, in effect, no radial can be found along which a continuous path of the material of the support arm extends from inner support portion 63 to outer support portion 67. This may be explained with reference to support arm 630. As illustrated in FIG. 6, support arm 630 includes a first substantially straight side 632 and a second substantially straight side 634 essentially parallel to side 632. A reference radial illustrated as 650 passes through a point 651 which represents the junction of side 632 of support arm 630 with inner annular support region 63 at dashed line 662. The opposite end of side 632 of support arm 630 intersects outer annular support region 67 at a point 653 lying on a radial 654. Side 634 of support arm 630 intersects inner annular support region 63 at a point 655 lying on dashed line 662, and intersects outer annular support region 67 at a point 656 lying on dashed line 668. Point 655 lies on a radial illustrated as 657. Radial 657 is separated from radial 650 by an angle $+\theta_1$, where positive values of B are clockwise in FIG. 6. Radial 657 is closer to radial 650 than is radial 654, which is separated from radial 650 by an angle $+Q\theta_1$, where $Q<1$. Consequently, all radials lying between radials 650 and 657 encounter a gap in the material of diaphragm spring 60, the gap lying in the region between side 632 and dashed line 668. Radials lying between radials 654 and 657 cross two gaps within resilient region 610, a first lying in the region between dashed line 662 and side 634 of support arm 630, and a second lying between side 632 of support arm 630 and dashed line 668. Those radials lying between radials 654 and 658 encounter a single gap, namely that gap lying in the region between dashed line 662 and side 634 of support arm 630. It should be noted that, if the support arms lying in spring region 610 are closely spaced as illustrated by support arms 612, 614 . . . , that the gaps in the material of diaphragm spring 60 will still exist adjacent the sides, such as sides 632 and 634 of support arm 630, but may not extend all the way to the edges of the inner and outer support regions 664 and 666. Nevertheless, the existence of a gap in spring region 610 for all radials prevents oil-canning and therefore promotes relatively smooth motion.

Oil-canning is prevented by angling the support arms and by selecting the points of intersection of the sides of the support arms to prevent a radial line of material between the inner and outer support regions. The angle made by the support arm and its sides with a radial is selected so that the length of the support arm is sufficient to provide the desired range of compliance. Based upon the results of finite-element analysis it has been determined that the sides of a support arm, such as sides 632 and 634 of support arm 630 of FIG. 6, should be substantially parallel (the arms should not be tapered in width) in order to have the highest possible self-resonant frequency of the support arm.

A design procedure for laying out the support arms on a diaphragm spring considers the thickness, material and geometry of the spring, and may consider the moving mass. For certain spiral diaphragm springs the natural frequency of the spring/mass system is proportional to $$fn\ \alpha(t^{1.5}, E^{0.5}, w^{0.5}, L^{-1.5}, \text{and } m^{-0.5}), \quad (1)$$

and the fundamental natural frequency $f_s$ of each spring is proportional to $$fs\ \alpha(t, E^{0.659}, L^{-2}, \rho^{-0.5}) \quad (2)$$

where t=thickness of the spring
E=Young's modulus of the spring material
w=width of each spring segment
L=length of each spring segment
m=moving mass
$\rho$=density of the spring material.

For use with a plunger to be actuated at a high rate, the ratio fs/fn should be a maximum, which suggests decreasing the values of t, w, L and $\rho$, and increasing the values of E and m. Also, the ratio of fs/fn may be improved by changes in the geometry of the resilient portion, and more specifically by appropriate selection of the shape and disposition of each support arm or springlet.

The frequencies of undesirable motional modes of the moving plunger such as tilting and translation in the plane of the diaphragm spring may be reduced (made worse) by minimizing thickness t and width w, and by increasing the moving mass m. Thus, these undesirable body modes present a lower limit on the selection of t and w and a maximum limit on m.

Noting that fs/fn is proportional to $E/\rho$, achieving high values of fs/fn may be aided by use of materials such as

| | |
|---|---|
| beryllium | $E/\rho$ = 560 |
| aluminum | 118 |
| carbon steel | 106 |
| stainless steel | 100 |
| magnesium alloy | 98 |
| beryllium copper | 57. |

The beryllium copper has the best fatigue resistance, and is the material of choice. Beryllium would be advantageous but for its poor notch resistance.

A firm mathematical foundation for determining the working range of compliance or displacement has not been found, but the range appears to be dependent upon thickness t and is approximately proportional to $t^{-2.75}$.

A possible design procedure begins with preestablished inside (ID) and outside (OD) diameters (from the diameter of the plunger, and taking into account the need for inner and outer support regions). An estimate is then made of the width w of one support arm or strut. With this estimated width, the number n of struts can be determined by assuming that they are contiguous (touching or nearly touching) at the known inner diameter, and by use of the expression $$N = \frac{\pi(ID)}{w} \quad (3)$$

Since n as calculated may be a fractional number, and there can be no fractional support element, the number n is rounded down to the next lower integer to become $n_i$. The angular distance $\theta_1$ along the working ID is calculated from $$\theta_1 = 360°/n_i \quad (4)$$

Referring to FIG. 6 to form the layout, select a reference radial line (650). Its intersection with ID (dashed line 662) is the beginning of one side of the support strut. Move in the positive angular direction from radial line 650 by an angle $Q\theta_1$, where Q is a coefficient having a value greater than unity, which may be 1.2. Draw a radial (654) at angle $Q\theta_1$. The intersection of radial 654 with the OD (line 668) establishes the end of the first side of the support strut, and also establishes the length of the support strut. The value of Q must be selected to provide a length of the support strut which provides the desired compliance range and resonant frequency fs. The other side of the support strut begins on ID at an angle $\theta_1$ from reference radial 650, namely at the intersection 655 of radial 657 with dashed line 662. Point 656 at which the second side ends is $Q\theta_1$ from radial 657, on dashed line 668. The remaining support struts can be generated by repeating the layout operations by assigning radial line 657 as the new reference radial, using the same values of Q and $\theta_1$.

In operation, there is a small rotation of the plunger 20 as a function of axial displacement. This may have a further self-cleaning effect at the nose of the plunger.

Other embodiments of the invention will be apparent to those skilled in the art. For example, the strip conductors 14 may approach the through aperture 18 at angles other than 180°. Since the described elements are linear, the location of the disconnecting portion of bridge element 216 relative to the source and sink of signal is irrelevant, i.e., switch 200 of FIG. 2 has the same degree of isolation between transmission-line sections 14*a* and 14*b* regardless of whether the direction of current flow is from the left or the right. The ground conductor or plane on the underside of the dielectric plate may extend over the entire bottom surface, even though the transmission line portions defined by strip conductors in conjunction with the ground plane terminate at the apertures in the dielectric plate. While electromagnetic actuation has been illustrated, mechanical actuation may be by a cam or other actuator.

What is claimed is:

1. A shorting switch for a transmission line, comprising:

a dielectric plate with substantially parallel first and second major surfaces, said plate defining a first aperture extending between said first and second major surfaces, said aperture having a periphery;

first and second unbalanced transmission lines terminating adjacent said periphery of said first aperture, each of said transmission lines including an elongated strip conductor lying on said first major surface of said dielectric plate overlying a common ground conductor lying on said second major surface of said dielectric plate;

a bridging element of conductive material mechanically and electrically connected to said strip conductor of said first transmission line and extending across at least a portion of said first aperture, said bridging element being dimensioned and formed in such a manner that in its resting state it presses against and makes electrical contact with said strip conductor of said second transmission line for forming a continuous circuit coupling said first and second transmission lines;

bridge opening and electrical grounding means comprising a conductive plunger mounted in said first aperture and electrically connected to said ground conductor, said plunger being actuable between retracted and actuated positions, said retracted position being one in which said plunger does not make contact with said bridging element, and said actuated position being one in which said plunger presses against said bridging element so as to disconnect said bridging element from said strip conductor of said second transmission line, whereby said first transmission line in said actuated state of said plunger is electrically and mechanically disconnected from said second transmission line for reducing coupling between said first and second transmission lines, and said bridging element is also electrically connected to ground for further reducing the coupling between said first and second transmission lines.

2. A switch according to claim 1 wherein said bridge opening and electrical grounding means further comprises a conductive diaphragm spring including a central aperture and a periphery, said diaphragm spring having said periphery electrically and mechanically coupled to said ground plane, and said central aperture electrically and mechanically coupled to said plunger, for allowing axial motion of said plunger without the need for sliding contacts.

3. A switch according to claim 1 further comprising at least one conductive diaphragm spring defining a central aperture and a periphery, said plunger being electrically and mechanically coupled to said central aperture of said diaphragm spring, said periphery of said diaphragm spring being in mechanical and electrical contact with said ground conductor around the said periphery of aperture defined by said dielectric plate.

4. A switch according to claim 3, wherein said diaphragm spring comprises a beryllium-copper annular sheet in which said central aperture is centered on an axis and said periphery is also centered on said axis, said annular sheet further comprising an annular bowed portion centered on said axis, the direction of said bowing being in a direction parallel with said axis.

5. A switch according to claim 3, wherein said diaphragm spring comprises an annular inner support region centered on said central aperture, and an annular outer support portion to which said ground conductor is connected, and further comprises an annular spring region between said inner and outer support regions, said spring region including a plurality of approximately triangular apertures defining a plurality of support struts, each with straight, mutually parallel sides extending from said inner to said outer support portion, said approximately triangular apertures being oriented and dimensioned such that any radial line passes through at least one of said sides of one of said support struts.

6. A switch according to claim 1 comprising a further conductor electrically connected to said ground conductor, said further conductor being located near said first aperture on the side of said first major surface remote from said dielectric plate, said further conductor being dimensioned and oriented so as to make mechanical and electrical contact with said bridging element when said conductive plunger is in said actuated position.

* * * * *